US007277360B2

(12) United States Patent
Dufour et al.

(10) Patent No.: US 7,277,360 B2
(45) Date of Patent: Oct. 2, 2007

(54) RATCHET ASSEMBLY DEVICE FOR FITTING A BACK COVER AND/OR A BEZEL ONTO A WATCH CASE MIDDLE

(75) Inventors: Stéphane Dufour, Plan-les-Ouates (CH); Claude Moënne, Arenthon (FR)

(73) Assignee: Rolex S.A., Geneva (CH)

( * ) Notice: Subject to any disclaimer, the term of this patent is extended or adjusted under 35 U.S.C. 154(b) by 0 days.

(21) Appl. No.: 11/083,753

(22) Filed: Mar. 18, 2005

(65) Prior Publication Data

US 2005/0243654 A1 Nov. 3, 2005

(30) Foreign Application Priority Data

Apr. 30, 2004 (EP) ..... 04405270

(51) Int. Cl.
*G04B 37/00* (2006.01)

(52) U.S. Cl. ..... 368/88; 368/316

(58) Field of Classification Search ..... 368/88, 368/289, 291, 294, 312, 316
See application file for complete search history.

(56) References Cited

U.S. PATENT DOCUMENTS 2,737,010 A * 3/1956 Piquerez ..... 368/291
2,858,663 A * 11/1958 Schwarz ..... 368/286
3,855,786 A * 12/1974 Yamamoto ..... 368/287
4,068,466 A * 1/1978 Tissot ..... 368/292
4,198,811 A * 4/1980 Ratajski ..... 368/292
4,362,401 A * 12/1982 Mitamura et al. ..... 368/309
5,455,808 A * 10/1995 Grupp et al. ..... 368/82

FOREIGN PATENT DOCUMENTS

| | | |
|---|---|---|
| CH | 215 994 | 7/1941 |
| CH | 217 009 | 9/1941 |
| CH | 258 894 | 12/1948 |
| CH | 423 637 | 5/1967 |
| CH | 447 046 | 3/1968 |
| CH | 512 769 | 10/1971 |
| CH | 556 567 | 6/1974 |
| FR | 1387021 | 6/1963 |

* cited by examiner

*Primary Examiner*—Vit Miska
*Assistant Examiner*—Thanh S. Phan
(74) *Attorney, Agent, or Firm*—Sturm & Fix LLP

(57) ABSTRACT

An elastic assembly joined to at least one side face of one of the members to be assembled is engaged by elastic deformation with a ratchet fastening element fixedly connected to the other member to be assembled. These elastic assemblies are constituted by an elongated element. The assembly side face to which it is joined has an elongated receptacle for the reception thereof, this forming in the assembly side face a opening through which a side portion of its wall projects to lie within the trajectory of the ratchet fastening element so as to allow coupling of this ratchet fastening element, at least one of the faces of the latter being configured to hold the elongated element under elastic strain and being orientated to resolve the force exerted upon it into a component which tends to hold the assembled members in place.

18 Claims, 4 Drawing Sheets

RATCHET ASSEMBLY DEVICE FOR FITTING A BACK COVER AND/OR A BEZEL ONTO A WATCH CASE MIDDLE

CROSS REFERENCE TO RELATED APPLICATIONS

This application claims priority of European Application No. 04405270.2 filed Apr. 30, 2004, and is included herein in its entirety by reference made hereto.

BACKGROUND OF THE INVENTION

1. Field of the Invention

The present invention relates to a ratchet assembly device for fitting a back cover and/or a bezel onto a watch case middle, in which at least one elongated elastic assembly element is combined with at least one elongated receptacle made in an assembly side face of one of the members to be assembled and forming in said assembly side face an opening through which a side portion of the surface of said elongated element projects for engagement by elastic deformation with a ratchet fastening element, fixedly connected to the other member to be assembled, upon the relative translatory displacement of these two members to fit them together, at least one of the faces of said ratchet fastening element being configured to hold said elastic assembly means under elastic strain and being orientated to resolve the force exerted upon it into a component parallel to said translatory displacement and the direction of which tends to hold said assembled members in place.

2. Description of Related Art

There are a large number of watch cases in existence, especially watertight watch cases in which the members to be fitted onto the case middle, the back cover and/or the bezel, are ratchet fastened. This fastening method is used, in particular, for watertight, so-called shape watches, that is to say watches of polygonal shapes, on which assembly cannot be realized by screwing a thread made on the back cover into a thread made on the case middle.

Such a fastening method is described, in particular, in CH 556 567, relating to a shape case in which a catch is made on the inner side face of the case middle by two faces inclined in opposite directions, an inwardly inclined surface followed by the other surface of opposite inclination, such that a constriction is made at the junction between these two surfaces. The back cover has a rim extending toward the interior of the case and the outer surface of the upper end of this rim forms the assembly surface. The distance between two opposing assembly surfaces of the back cover must be slightly greater than the corresponding dimension of the constriction made at the junction of the inclined surfaces of the inner side face of the case middle. When the back cover is introduced into the case middle, the rim is deformed, and at least partially resumes its original position once it has passed beyond the constriction, thus detaining the back cover on the case middle. A seal is accommodated in the outer side face of the rim of the back cover, beneath the assembly surface, such that this seal is compressed against the assembly surface of the outwardly inclined case middle.

The drawback of such an assembly system derives from the fact that the back cover is not necessarily made of a material chosen for its elastic properties, such that the rim of the back cover, whose elastic deformation serves to allow the ratchet fastening, does not confer good elastic deformation properties. Consequently, since the elastic limit may not be exceeded, the margin of deformation for the coupling is necessarily small. Considering, on the one hand, the small deformation permitted for the coupling and, on the other hand, the production tolerances, it is then no longer possible to fit any back cover to any case middle, which may dictate that the back covers and the case middles are classified according to the actual dimensions of the distances between the respective opposing assembly surfaces of the members to be assembled, or to their diameters in the case of round cases. Such a task clearly constitutes a constraint which is not easy to manage. In addition, depending on the materials used, the coupling properties of such an assembly method may vary, especially according to the number of times that the back cover of the case is opened and closed.

In this type of assembly, moreover, involving watertight watches, the compression of the seal generally exerts a force opposite to the closing force, as in FR 1 387 021, which can adversely affect both the correct closure of the back cover and the watertightness when this compression results from a ratchet fastening rather than a screw fastening.

The use of an elastic closing element independent of the members to be assembled has been proposed, as in CH 423 637 or in CH 447 046. The drawback of the elastic elements proposed in these documents lies essentially in their bulk. In CH 512 769, it has also been proposed to use pins made of compressible materials, surrounded by ring segments which cooperate with mill-cuts made in the angles of a square or rectangular case. Such a device can only be used on shape cases and the elasticity given by an elastomer-type compressible material is likely to alter considerably as the material ages.

Finally, in U.S. Pat. No. 2,858,663, a ratchet closing device for a watch case back cover has been proposed, comprising a polygonal split ring accommodated in a groove made in an inner side face of the case middle. The tops of the polygonal sides of this ring rest in the bottom of the groove, whereas the central portions of these polygonal sides protrude from this groove and extend inside the opening in the case middle intended to receive the back cover of the case. The latter has a first frustoconical surface, the top of which is situated above the case middle, followed by a second frustoconical surface, the top of which is situated beneath the case middle. When the back cover is ratchet fitted onto the case middle, the first frustoconical surface serves to return the central portions of the polygonal ring into the groove in the case middle, whereas the second frustoconical surface serves to press the back cover axially against a seal accommodated in the bottom of the opening in the case middle intended to receive the back cover of the case.

In such a device, the axial force which presses the back cover against the seal results from the mere bending of the sides of the polygonal ring. On the other hand, in the absence of any further clarification, it is incomprehensible how this fastening method by bending of polygonal segments in a circle could be used in the case of a square or rectangular case.

A bayonet fastening device, in which two fastening lugs fixedly connected to the back cover of the case engage with two portions of an elastic split ring projecting inside the case middle, is described in U.S. Pat. No. 2,737,010. In the closing position, the frustoconical surface of the back cover engaging with the split ring can produce an axial pressure to compress a seal.

Apart from the fact that only the bending of the elastic closing elements is used, it can be seen that the axial force component resulting from this bending generally serves, moreover, to compress a seal, hence to reduce the axial force used to fasten the back cover onto the case middle. Pending proof to the contrary, moreover, the last two aforementioned solutions are not apparently applicable to square or rectangular cases.

BRIEF SUMMARY OF THE INVENTION

The object of the present invention is to eliminate the aforementioned drawbacks, at least in part.

To this end, the subject of the present invention is a ratchet assembly device for fitting a back cover and/or a bezel onto a watch case middle, as claimed in claim 1.

The use of a coupling tube according to the present invention occupies little space. The wall of a tube constitutes an excellent elastic element. The elasticity may be given by elastic deformation of the profile of the section of the tube. As a variant, the elongated element of tubular section may be a bending member held at its two ends. The coupling force in the case of a tubular coupling element can be adjusted either by modifying the thickness of the wall of the tube, or, preferably, by modifying the length of the tube. This coupling force can also be adjusted by an appropriate choice of tube material.

The present invention applies particularly advantageously to polygonal watch cases, also referred to as shape cases (implying: other than circular in shape).

BRIEF DESCRIPTION OF THE DRAWINGS

Other peculiarities and advantages of this invention will emerge in the course of the following description, which relates to different embodiments of the assembly device forming the subject of the present invention, illustrated diagrammatically and by way of example by the appended drawings, in which.

DETAILED DESCRIPTION OF THE INVENTION

Figure 1:
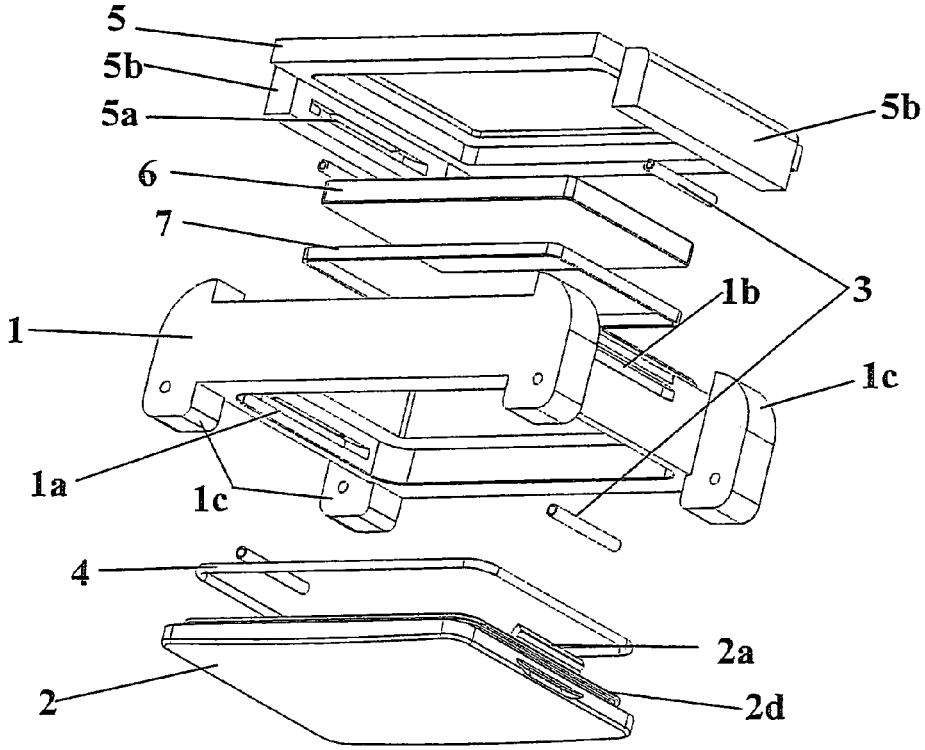
FIG. 1 is an exploded projection of a watch case illustrating the preferred embodiment of this assembly device.

The wristwatch case illustrated by FIG. 1 comprises a case middle 1, in this example rectangular in shape, and a back cover 2 comprising two ratchet fastening lugs 2*a*, joined to two opposing sides of the back cover 2 and only one of which is visible in FIG. 1. Each ratchet fastening lug 2*a* extends above a nesting surface 2*d* of the back cover 2 and is intended to cooperate with an elongated elastic coupling element, in this preferred example in the form of a tube 3, the wall of which is elastically deformable, as will be explained below. Each of the two coupling tubes 3 is intended to be accommodated in a receptacle 1*a* made in an inner assembly side face of the case middle 1. The two receptacles 1*a* are disposed in two respective opposing side faces. Each of these receptacles 1*a* extends parallel to these opposing side faces and parallel to the planes of the openings in the case middle 1, which openings are closed by the back cover 2, or by the bezel 5.

Figure 2:
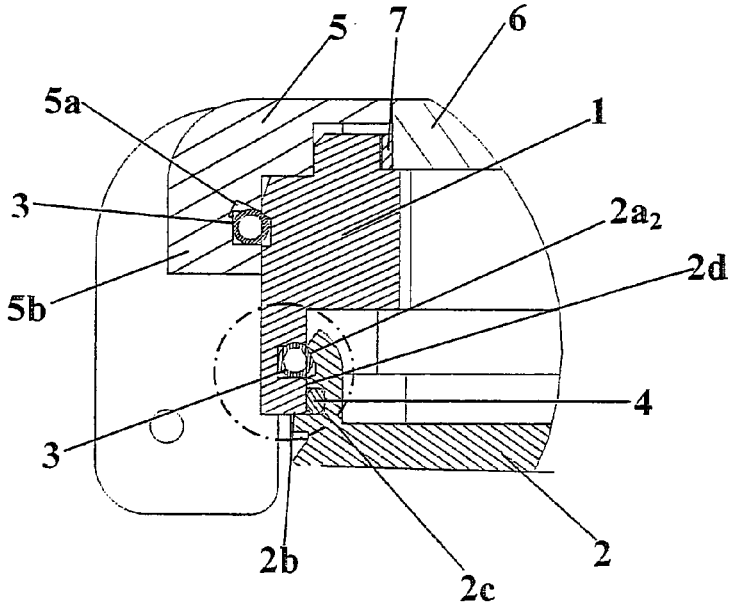
FIG. 2 is a partial view in vertical section, showing the back cover and the bezel fitted on the case middle.
Figure 4:
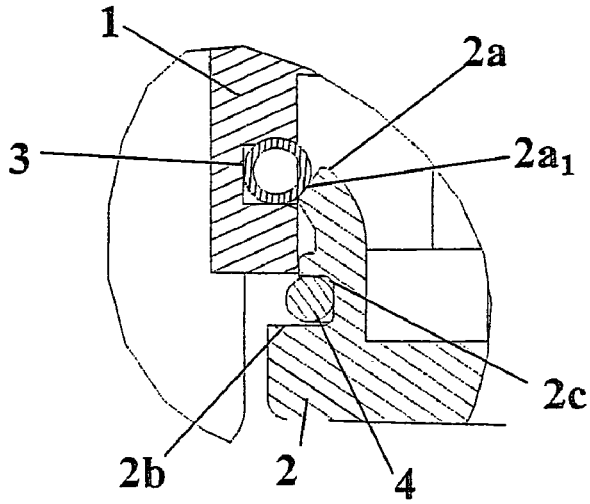
FIGS. 4 and 5 are partial sectional views showing the case portion circled in dash-dot lines in FIG. 2, in the different stages of fitting of the assembly device.
Figure 5:
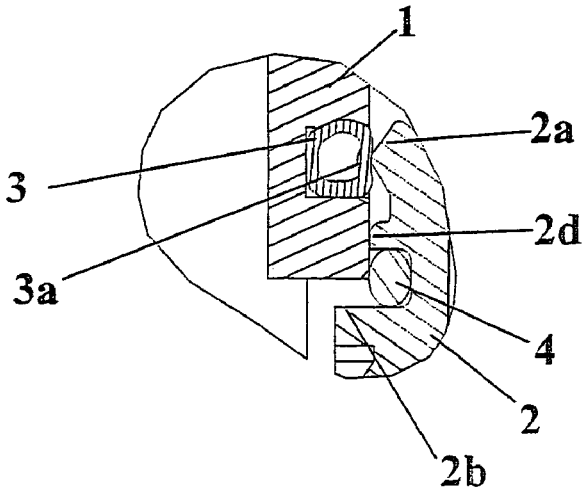

A seal 4 is intended to be accommodated in a groove 2*c* made over the whole of the circumference of the nesting face 2*d* of the back cover 2 into the case middle 1 (FIGS. 2, 4, 5).

In the embodiment illustrated by FIG. 1, a bezel 5 is also intended to be fastened to the case middle 1 by the assembly device forming the subject of the present invention. A glass 6 and a seal 7 are intended to be fitted onto the case middle 1 upon the ratchet fastening of the bezel 5. To this end, this bezel 5 comprises two receptacles 5*a* made in the inner faces of two fastening lugs 5*b* intended to be accommodated between the horns 1*c* of the case middle 1. Each receptacle 5*a*, only one of which is visible in FIG. 1, is intended to receive a coupling tube 3. Each of these coupling tubes 3 is intended to allow the fastening of two catches 1*b*, made between the horns 1*c*, on two opposing outer side faces of the case middle 1.

FIG. 2 illustrates the back cover 2 and the bezel 5 fitted on the case middle 1, the seal 4 being compressed between the inner side face of the case middle 1 and the bottom of the groove 2*c*. The ratchet fastening of the fastening lug 2*a* of the back cover 2 is engaged on the coupling tube 3 and holds the profile of the deformed straight section thereof. This deformation lies clearly within the limit of elastic deformation. The inclined face $2a_2$ of the fastening lug 2*a* upon which the elastic force generated by the deformation of the straight section of the coupling tube 3 is exerted resolves this force into a component which exerts constantly upon the back cover 2 a force which holds the rim 2*b* thereof pressed against the base of the case middle 1.

It can be seen, on the other hand, that the force exerted by the coupling tube 3 upon the back cover 2 has no effect on the compression of the seal 4 and that, reciprocally, the compression force of the seal 4 does not yield to the force applied by the rim 2*b* of the back cover to the base of the case middle 1, since the compression force of the seal 4 is perpendicular to that which is used to press the rim 2*b* of the back cover 2 against the base of the case middle 1. The independence between the force necessary for the coupling of the back cover 2 and that necessary for the compression of the seal 4 is a peculiarity of the assembly device according to the present invention, which peculiarity clearly constitutes an advantage, since it allows optimal adjustment of the parameters relating to these two functions.

Since the same assembly device is used to fasten the bezel 5 onto the case middle 1, there is no need to describe it anew. It has been shown in this example that the coupling tubes 3 of the bezel 5 are fastened in receptacles 5*a* in the bezel, whereas the catches 1*b* are made on the case middle. It would clearly be possible for the receptacles 5*a* to be made in the case middle and for the catches 1*b* to be made on the bezel.

Figure 3:
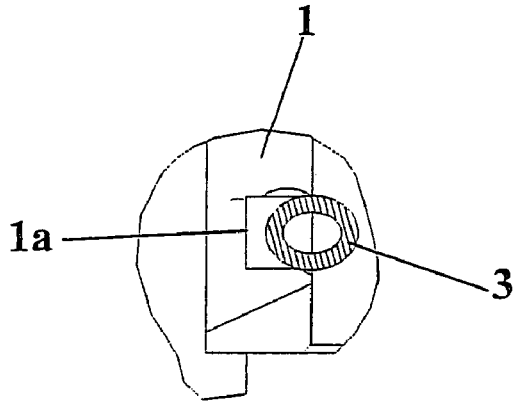
FIG. 3 is a partial sectional view of that part of the case middle which is situated inside the circle represented in dash-dot lines in FIG. 2.

FIGS. 3 to 5 show different phases of assembly of the back cover 2 onto the case middle 1 by relative translatory displacement of these two members, by means of the assembly device described above. FIG. 3 shows the fitting of the coupling tube 3 in its receptacle 1*a* in the case middle 1. It can be seen that the size of the opening in the receptacle 1*a* in the inner side face of the case middle 1 is less than the diameter of the coupling tube 3. In this case, the latter must therefore be elastically deformed to penetrate the receptacle 1*a*, as illustrated by FIG. 3.

FIG. 4 shows the tube 3 in its receptacle 1*a*, which is configured to allow it to regain the original shape of the profile of its section, and that a sector of the wall of the coupling tube 3 projects from this receptacle 1*a* and hence from the assembly side face of the case middle 1*a*. It is also apparent in this figure that the ratchet fastening lug 2*a* of the back cover has an inclined lead-in face $2a_1$. This comes initially into contact with that sector of the wall of the coupling tube 3 which projects inside the assembly side face of the case middle 1. This inclined face $2a_1$ allows a part of the force exerted to introduce the back cover 2 into the case middle 1 to be transmitted to the wall of the coupling tube 3. As illustrated by FIG. 5, this force allows the section of the coupling tube 3 to be deformed up to the final coupling position illustrated by FIG. 2.

Although it is shown, in this example, that the whole of the elastic deformation, in the coupling of the back cover, is provided by the coupling tubes 3, this is not essential and the assembly device could also function with an elastic deformation of the ratchet fastening lugs 2*a*, or with an elastic deformation distributed over the coupling tubes 3 and the ratchet fastening lugs 2*a*. Nevertheless, as previously indicated, the material of which the back cover is made is not generally chosen according to its elastic property, or, at least, this does not constitute its main property. This is not the case with the coupling tube 3, such that, advantageously, it has the propensity to provide the substance of the elastic properties of the assembly device.

In the assembly device according to the present invention, the ratchet fastening is situated inside the watertight space protected by the seal 4, such that this ratchet fastening is protected from external attack.

The coupling force of the assembly device can be controlled by means of the coupling tubes 3. Firstly, a wall thickness for these coupling tubes 3 can be chosen. Advantageously, the coupling force for a given wall thickness of a tube 3 will be controlled by varying the length of these tubes 3. It is thus possible to have tubes 3 of different lengths. It is also possible to use a plurality of tubes 3 placed end to end. It would be conceivable, for example, to have tubes 3 of a defined standard length, the control consisting in placing a certain number of standard tubes 3 end to end, the standard length being chosen to give a small, yet nevertheless perceptible force variance, to allow the coupling force to be finely controlled by the addition or removal of a standard tube.

Figure 7:
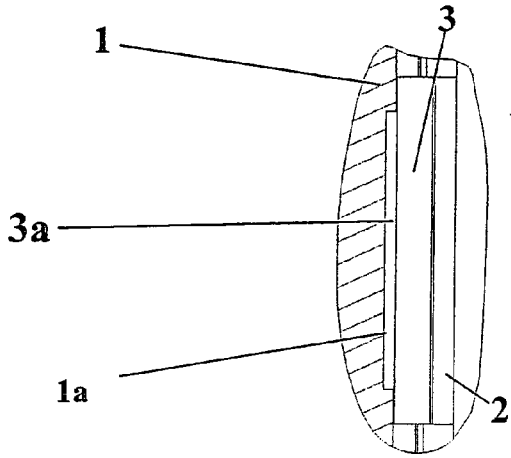
FIG. 7 is a sectional view along the line VII-VII of FIG. 6.
Figure 6:
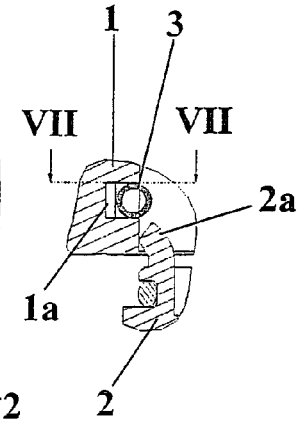
FIG. 6 is a partial view similar to that of FIG. 2 of another embodiment of the assembly device.
Figure 9:
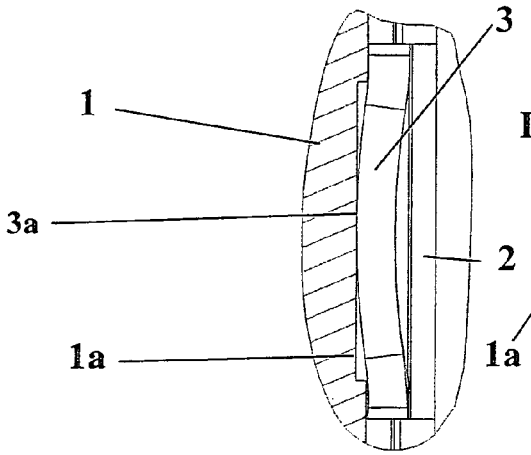
FIG. 9 is a sectional view along the line IX-IX of FIG. 8.
Figure 8:
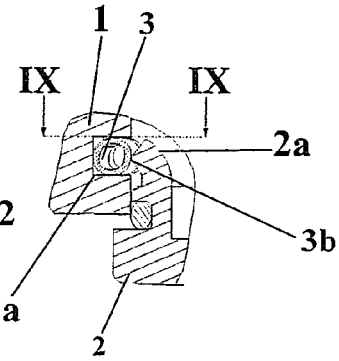
FIG. 8 is a sectional view similar to FIG. 6, showing the members of the device in the course of assembly.
Figure 11:
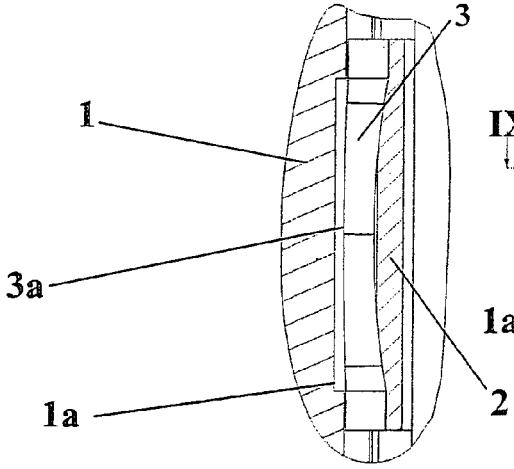
FIG. 11 is a sectional view along XI-XI of FIG. 10.

In the variant illustrated by FIGS. 6 and 7, the basic difference derives from the fact that, besides the deformation of the profile of the tubular element 3, its elastic bending is also used. To this end, the receptacle 1*a* for the tubular coupling elements 3 has, between its two ends acting as support for the ends of the tubular coupling element 3, a slight central crank, as illustrated by FIGS. 7, 9 and 11, preferably chosen to limit the degree of bending of the tubular coupling element 3. Thus, since the tubular coupling elements 3 are straight, they rest only at their ends in the receptacles 1*a*. Upon the fitting or removal of the back cover 2, as illustrated by FIGS. 8 and 9, apart from the deformation which may be suffered by the profile of their section, the tubular coupling elements 3 can bend. In this case, it is clearly necessary for the tubular element 3 to be in one piece and to be substantially longer than the ratchet fastening lugs 2*a*. These must clearly be situated in the central part of the tubular coupling elements 3 in order to make them bend. In this variant, the detention of the tubular coupling elements 3 in their receptacles 1*a* is obtained by constriction of the inlet opening in these receptacles 1*a*, as in the embodiment of FIGS. 1 to 5, but only at the two ends of these receptacles 1*a*, whereas the tubular coupling elements 3 are loose between their ends, such as not to inhibit their bending within the limit set by the depth of the central recess in the receptacle 1*a*, which depth is chosen according to the chosen maximum degree of bending.

As shown by the embodiment of FIGS. 6 to 11, it should be noted that the fastening device according to the present invention is not intended exclusively for watertight watch cases, even though this is the preferred application of this invention.

Figure 10:
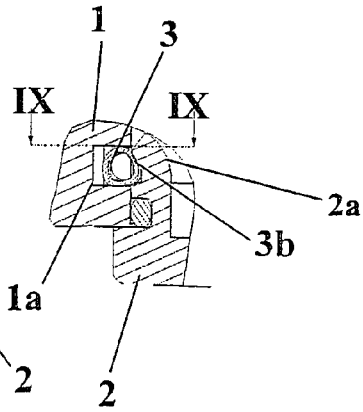
FIG. 10 is a view similar to FIG. 6, showing the members of the device in assembled position.

FIGS. 10 and 11 show that, when the catches 2*a* of the back cover 2 are engaged on the elastic coupling elements, the tubular coupling element 3 does not necessarily regain its original shape illustrated by FIGS. 6 and 7, but that the catches 2*a* can also hold it under a certain flexion and that the resultant force is added to a component deriving from the deformation of the tubular profile and directed so as to press the rim 2*b* of the back cover against the lower face of the case middle 1.

This variant, in which the bending is combined with the deformation of the tubular section of the coupling element 3, can facilitate the adjustment of the coupling force. It can also make the coupling and decoupling of the back cover and/or of the bezel more elastic. It also allows the production tolerances to be somewhat increased and allows materials to be chosen for the tubular coupling elements 3 which have better elastic bending properties.

Figure 13:
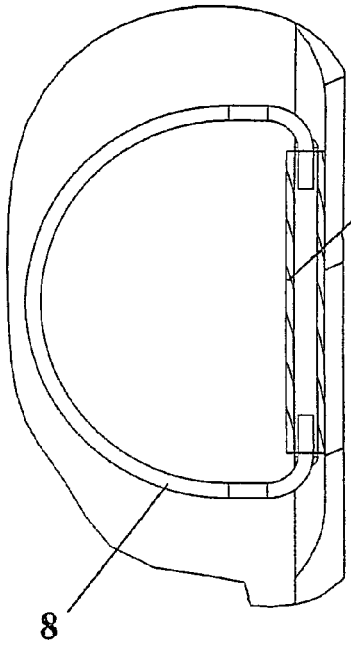
FIG. 13 is a sectional view along the line XIII-XIII of FIG. 12.
Figure 12:
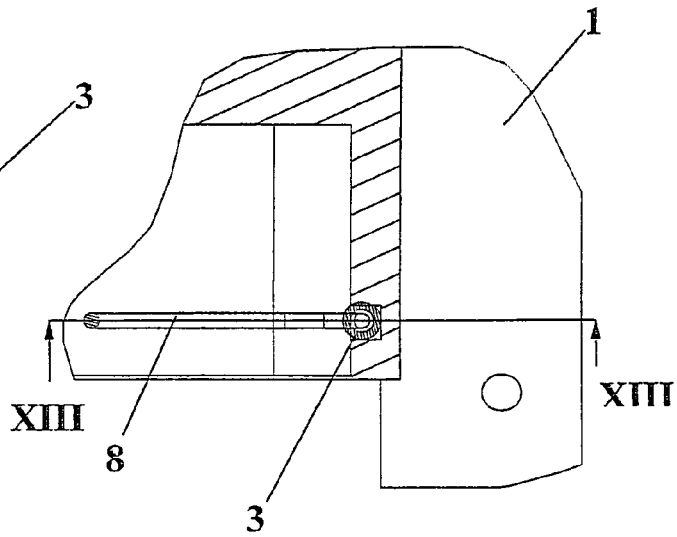
FIG. 12 is a sectional view, showing only the case middle.

FIGS. 12 and 13 show a tool 8 which can be used to remove the coupling tubes from their receptacles 1*a*. This tool 8 has the form of a C-shape, elastically deformable loop. The two ends adjacent to the opening in this loop are rectilinear and coaxial, such that, after having been distanced apart, they can be introduced into the respective ends of the coupling tube 3. Once the ends of this tool 8 are engaged in the ends of the coupling tube 3, as illustrated by FIG. 12, all that is required is to pull on the loop formed by this tool 8. It is clearly not essential for the coupling tubes to be fastened in the receptacles 1*a*. Nevertheless, this detachable fastening of the coupling tubes 3 in their receptacles 1*a* substantially simplifies the work in comparison to loose coupling tubes, which might otherwise escape from their receptacles with each removal of the back cover 2 or the bezel 5 and get easily lost.

The present invention can be used to particular benefit where the back cover and/or the bezel are fitted onto a watch case middle of polygonal, especially square or rectangular shape. This invention is not, however, limited to this type of case. It might also be used for oval or round watch cases.

Figure 14:
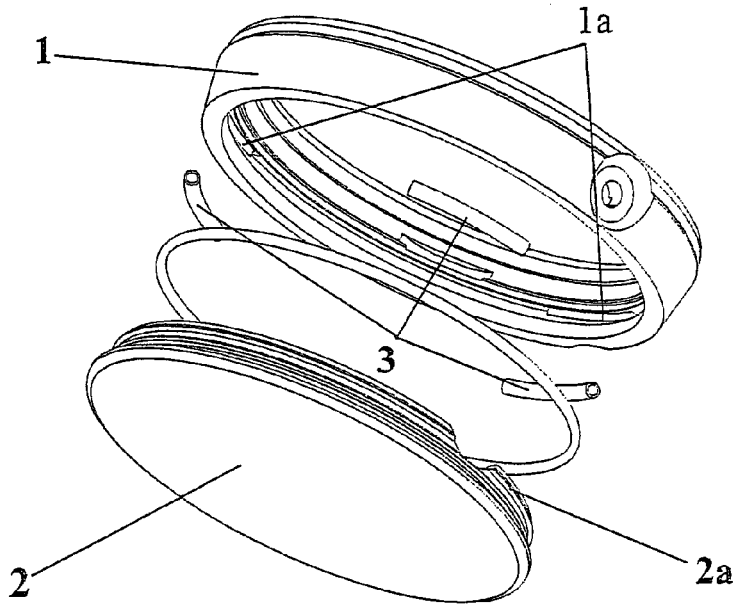
FIG. 14 is a partial, exploded projection of a variant of the assembly device applied to a round watch case.

FIG. 14 illustrates the assembly device forming the subject of the present invention and used to fasten a circular back cover 2 onto a round case middle 1. In this variant, the assembly is realized as previously described, with the sole difference that the coupling tubes 3 are in the form of toric segments and that the receptacles 1*a* made to receive them in the inner side face of the case middle 1 are in the form of circular arcs of the same radius of curvature as that of the toric segments forming the coupling tubes 3.

In one variant (not represented), the coupling tube 3 could be formed by a helical spring with contiguous spirals, this being the case for all of the embodiments previously described in which the elongated coupling element is formed by a tube.

The invention claimed is:

1. A ratchet assembly device for fitting a back cover and/or a bezel onto a watch case middle, comprising at least one elongated elastic assembly element combined with at least one elongated receptacle made in an assembly side face of one of the members to be assembled and forming in said assembly side face an opening through which a side portion of the surface of said elongated element projects for engagement by elastic deformation with a ratchet fastening element, fixedly connected to the other member to be assembled, upon the relative translatory displacement of these two members to fit them together, at least one of the faces of said ratchet fastening element being configured to hold said elastic assembly element under elastic strain and being orientated to resolve the force exerted upon it into a component parallel to said translatory displacement and the direction of which tends to hold said assembled members in place, wherein said elongated elastic assembly element is of tubular section and wherein a straight section of this receptacle is configured to allow the profile of a straight section of said elongated elastic assembly element of tubular section to be deformed by said ratchet fastening element upon coupling thereof.

2. The device as claimed in claim 1, wherein the longitudinal profile of said receptacle matches the longitudinal profile of said elongated elastic assembly element of tubular section.

3. The device as claimed in claim 2, wherein the central part of said longitudinal profile of the receptacle comprises a clearance dimensioned to allow limited bending of said elongated elastic assembly element of tubular section.

4. The device as claimed in claim 3, wherein the assembly side face of one of said members to be assembled bears a seal arranged for compression by a force directed substantially perpendicularly to said side face and parallel to said translatory displacement.

5. The device as claimed in claim 3, wherein the two-dimensional profile of the case middle is polygonal.

6. The device as claimed in claim 2, wherein said case middle is circular in shape and wherein said elongated elastic assembly element of tubular section has the shape of a toric segment.

7. The device as claimed in claim 6, wherein said elongated elastic assembly element of tubular section is formed by a helical spring.

8. The device as claimed in claim 6, wherein the assembly side face of one of said members to be assembled bears a seal arranged for compression by a force directed substantially perpendicularly to said side face and parallel to said translatory displacement.

9. The device as claimed in claim 2, wherein said elongated elastic assembly element of tubular section is formed by a helical spring.

10. The device as claimed in claim 9, wherein the assembly side face of one of said members to be assembled bears a seal arranged for compression by a force directed substantially perpendicularly to said side face and parallel to said translatory displacement.

11. The device as claimed in claim 9, wherein the two-dimensional profile of the case middle is polygonal.

12. The device as claimed in claim 2, wherein the assembly side face of one of said members to be assembled bears a seal arranged for compression by a force directed substantially perpendicularly to said side face and parallel to said translatory displacement.

13. The device as claimed in claim 1, wherein the assembly side face of one of said members to be assembled bears a seal arranged for compression by a force directed substantially perpendicularly to said side face, or to said force component parallel to said translatory displacement.

14. The device as claimed in claim 13, wherein said elongated elastic assembly element of tubular section is disposed inside the watertight space made in the watch case by said seal.

15. The device as claimed in claim 1, wherein the case middle has a stop surface against which a corresponding stop surface of the back cover or of the bezel is pressed by an axial force exerted upon said back cover or said bezel by said elongated elastic assembly element of tubular section engaging with a catch.

16. The device as claimed in claim 1, wherein said assembly surface to which said elongated elastic assembly element of tubular section is joined is the case middle.

17. The device as claimed in claim 16, wherein the two-dimensional profile of the case middle is polygonal.

18. The device as claimed in claim 1, wherein the two-dimensional profile of the case middle is polygonal.

* * * * *